US008928448B2

(12) United States Patent
Ohoka et al.

(10) Patent No.: US 8,928,448 B2
(45) Date of Patent: Jan. 6, 2015

(54) POWER SUPPLY APPARATUS

(71) Applicants: Nippon Soken, Inc., Nishio, Aichi-pref. (JP); Denso Corporation, Kariya, Aichi-pref. (JP)

(72) Inventors: Shinji Ohoka, Okazaki (JP); Takuya Okubo, Kariya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 14/154,751

(22) Filed: Jan. 14, 2014

(65) Prior Publication Data

US 2014/0197913 A1 Jul. 17, 2014

(30) Foreign Application Priority Data

Jan. 14, 2013 (JP) ..... 2013-004145

(51) Int. Cl.
*H01F 27/00* (2006.01)

(52) U.S. Cl.
USPC ..... 336/92

(58) Field of Classification Search
USPC ..... 336/65, 83, 90, 92, 96, 200, 232
See application file for complete search history.

(56) References Cited

U.S. PATENT DOCUMENTS

| | | | |
|---|---|---|---|
| 2005/0047175 | A1 | 3/2005 | Kawasaki et al. |
| 2008/0030293 | A1 | 2/2008 | Kawasaki et al. |
| 2009/0290388 | A1 | 11/2009 | Kawasaki et al. |

FOREIGN PATENT DOCUMENTS

| | | |
|---|---|---|
| JP | 11-299220 | 10/1999 |
| JP | 2001-044685 | 2/2001 |
| JP | 2005-051994 | 2/2005 |
| JP | 2005-051995 | 2/2005 |
| JP | 2006-180578 | 7/2006 |
| JP | 2007-037384 | 2/2007 |

*Primary Examiner* — Tuyen Nguyen
(74) *Attorney, Agent, or Firm* — Nixon & Vanderhye P.C.

(57) ABSTRACT

A power supply apparatus includes a magnetic component having a coil section, a conductive case body housing the magnetic component and having an opening plane facing an axial direction of the coil section, a case lid closing the opening plane, and conductive parts electrically connecting the case body and the case lid to each other at the opening plane. The conductive parts are provided so as to satisfy a positional relationship that at least one of the conductive parts is disposed at an intersection point at which a straight line making an angle within a range of 45±15 degrees with a perpendicular line drawn from a center of the coil section to a closest one of the side plate portions of the case body to the center intersects with the closest one of side plate portions when viewed from the axial direction.

6 Claims, 18 Drawing Sheets

POWER SUPPLY APPARATUS

This application claims priority to Japanese Patent Application No. 2013-4145 filed on Jan. 14, 2013, the entire contents of which are hereby incorporated by reference.

BACKGROUND OF THE INVENTION

1. Field of the Invention

The present invention relates to a power supply apparatus having a conductive case which houses electric and magnetic components.

2. Description of Related Art

An electric vehicle or a hybrid vehicle is provided with a power supply apparatus for a DC-DC converter or the like, which has a case housing electric components constituting a power supply circuit. For example, refer to Japanese Patent Application Laid-open No. H11-299220. The case is constituted of a conductive case body and a conductive case lid for electromagnetic shielding. Accordingly, this case prevents electromagnetic noise emitted from magnetic components such as a transformer or choke coil from leaking outside the case. This makes it possible to prevent electric components or electronic devices present in the vicinity of the power supply apparatus from being affected by the electromagnetic noise.

The reason is that, although a magnetic flux perpendicular to the bottom or case lid of the case is generated when the magnetic component is energized, since eddy currents flow in the inner surface of the case in a direction to cancel out the magnetic flux, the magnetic flux can be prevented from leaking outside the case.

However, since the case is constituted of a combination of the case body and the case lid, the eddy currents cannot flow from the case lid to the case body and vice versa sufficiently, if the conductivity at the joint surface between them is not high sufficiently. For example, if a gap or an oxide film is present in the joint surface, the conductivity of the joint surface is degraded. In this case, the eddy currents may leak from the inside surface to the outside surface of the case body or the case lid through the joint surface, causing electromagnetic noise to leak outside the case. Further, if the contact pressure at the joint surface is small, and accordingly, the contact resistance is large, a similar problem may occur. On the other hand, it is unfeasible to make the contact resistance sufficiently small throughout the circumference of the joint surface in view of the productivity and heat radiation performance of the case.

SUMMARY

An exemplary embodiment provides a power supply apparatus including:

at least one magnetic component having a coil section of a ring shape;

a case body housing the magnetic component and having an opening plane facing an axial direction of the coil section, the case body being made of a conductor and constituted of a bottom plate portion and a plurality of side plate portions standing from circumferential edges of the bottom plate portion toward the opening plane;

a case lid having an inner surface facing the opening plane so as to close the opening plane and; and a plurality of conductive parts electrically connecting the case body and the case lid to each other at the opening plane at a resistance lower than any other portion of the case body and the case lid; wherein the conductive parts are provided so as to satisfy a positional relationship that at least one of the conductive parts is disposed at an intersection point at which a straight line making an angle within a range of 45±15 degrees with a perpendicular line drawn from a center of the coil section of the magnetic component to a closest one of the side plate portions to the center intersects with the closest one of side plate portions when viewed from the axial direction.

Another exemplary embodiment provides a power supply apparatus including:

at least one magnetic component having a coil section of a ring shape;

a case body housing the magnetic component and having an opening plane facing an axial direction of the coil section, the case body being made of a conductor and constituted of a bottom plate portion and a plurality of side plate portions standing from circumferential edges of the bottom plate portion toward the opening plane; and a case lid closing the opening plane, the case lid being made of a conductor and constituted of a top plate portion and a plurality of vertical plate portions extending down from the top plate portion toward the opening plane; wherein when an axial dimension of the coil section of the magnetic component is H, and a positional difference in the axial direction between a center of the coil section and the opening plane is $\Delta h$, a relationship of $\Delta h/H \leq 0.25$ is satisfied.

According to these embodiments, there is provided a power supply apparatus capable of effectively suppressing leakage of electromagnetic noise from inside thereof.

Other advantages and features of the invention will become apparent from the following description including the drawings and claims.

PREFERRED EMBODIMENTS OF THE INVENTION

First Embodiment

Figure 1:
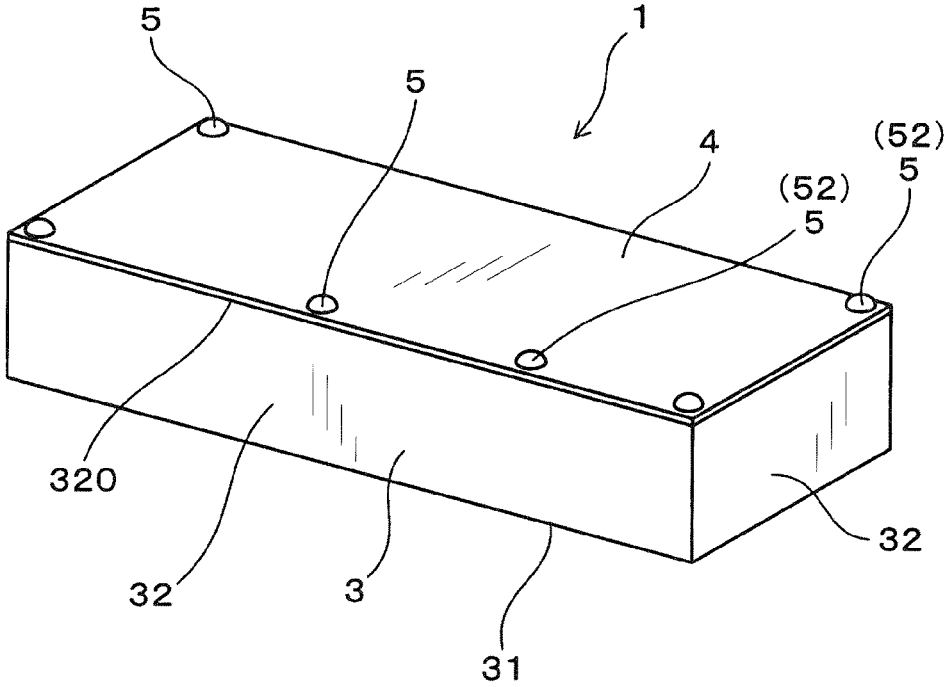
FIG. 1 is a perspective view of a power supply apparatus according to a first embodiment of the invention.

A power supply apparatus 1 according to a first embodiment of the invention is described with reference to FIGS. 1 to 9. As shown in FIGS. 1 to 4, the power supply apparatus 1 includes a magnetic component 2 including at least one coil section 21, a case body 3 which is made of a conductor, houses the magnetic component 2 therein and has an opening axially facing the coil section 21, and a case lid 4 closing the opening plane of the case body 3.

The case body 3 includes a bottom plate portion 31, and a plurality of side plate portions 32 standing from the circumferential edges of the bottom plate portion 31 toward the opening plane. The case lid 4 includes an inner surface 41 facing the opening plane of the case body 3. The power supply apparatus 1 also includes a plurality of conductive parts 5 which electrically connect the case body 3 and the case lid 4 to each other at the opening plane at a resistance lower than that at any other portions thereof.

Figure 2:
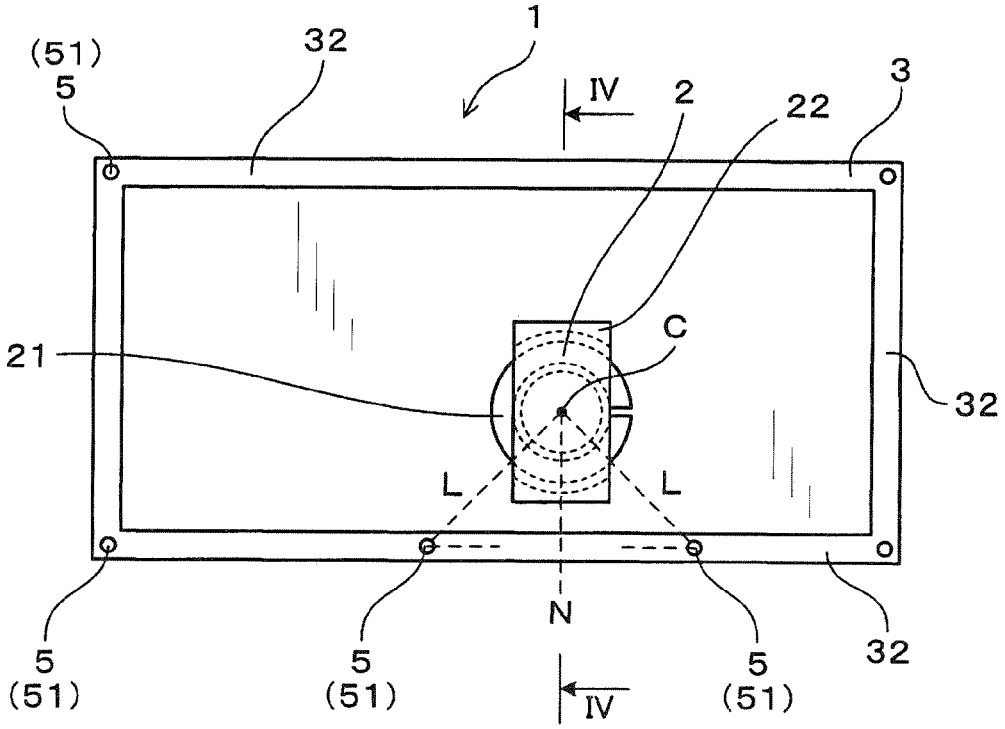
FIG. 2 is a plan view showing a positional relationship between the case body of the power supply apparatus according to the first embodiment and a magnetic component housed therein.

As shown in FIG. 2, the conductive parts 5 are disposed at two intersection points at which two straight lines L making the same angle within the range of 45±15 degrees with a perpendicular line N drawn from the center C of the coil section 21 of the magnetic component 2 to the closest side plate portion 32 respectively intersect with this closest side plate portion 32 when viewed from the axial direction. Here, the term "the axial direction" refers to the direction in which the coil section 21 is axially wound (the direction of the longitudinal axis of the coil section 21). This axial direction is also a direction in which the case body 3 and the case lid 4 are stacked on each other.

Figure 3:
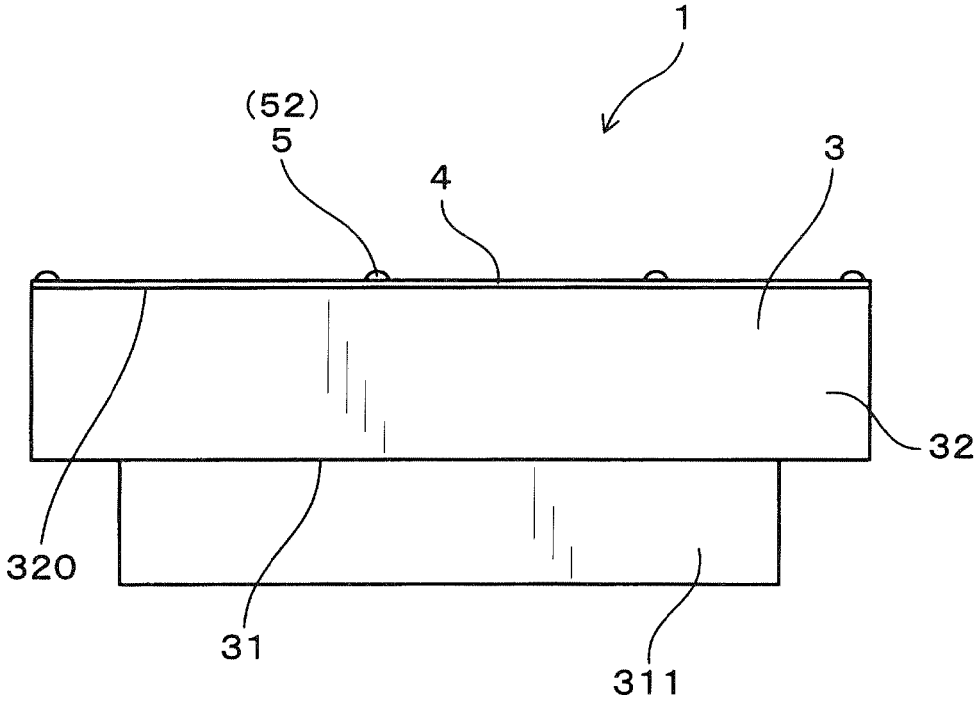
FIG. 3 is a side view of the power supply apparatus according to the first embodiment.
Figure 4:
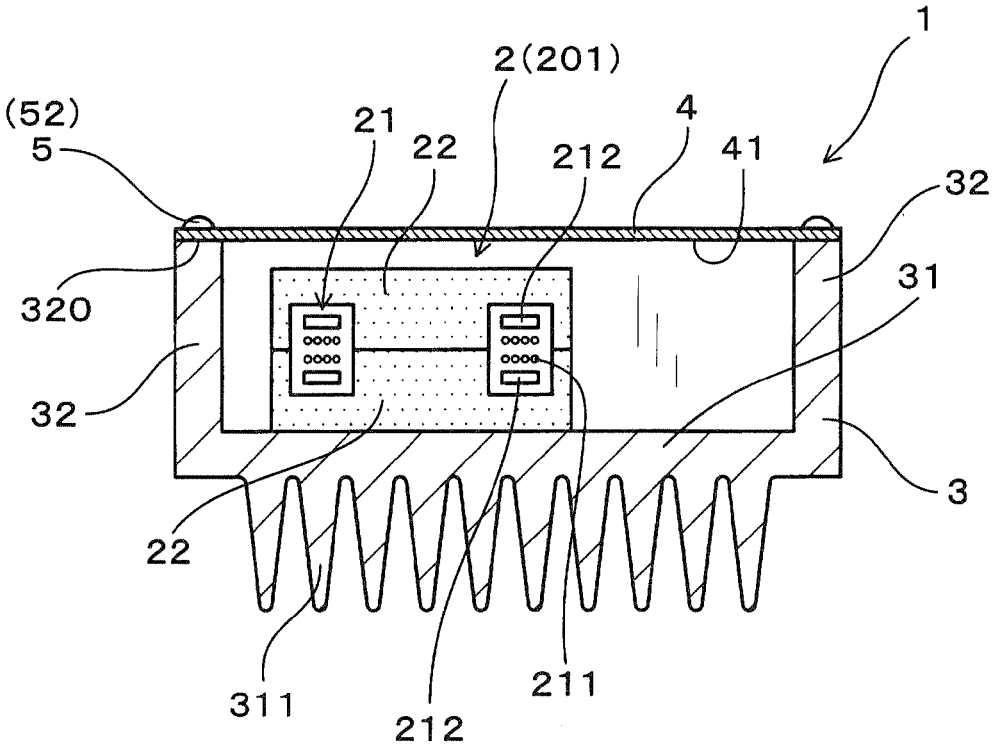
FIG. 4 is a cross-sectional view taken along line IV-IV in FIG. 2.

In this embodiment, the conductive parts 5 are screw-fastening parts. That is, as shown in FIG. 2, the case body 3 is formed with female screws 51. Male screws 52 are passed through insertion holes formed in the case lid 4 and engaged with the female screws 51 of the case body 3, so that the case lid 4 and the case body 3 are fastened to each other as shown in FIGS. 1, 3 and 4.

The case body 3 and the case lid 4 may be electrically connected to each other at portions other than the screw-fastening parts. However, in this embodiment, the electrical resistance between the case body 3 and the case lid 4 at the screw-fastening parts is lower than that at any other portion. This is because the pressure force between the case body 3 and the case lid 4 at the screw-fastening parts is larger than that at any other portions, and accordingly, the contact resistance between the case body 3 and the case lid 4 at the screw-fastening parts is lower than that at any other portion. In addition, since the male screws 52 serve as current paths, the electrical resistance at the screw-fastening parts becomes low. Hence, the screw-fastening parts make the conductive parts 5.

However, the conductive parts 5 do not necessarily have to be limited to the screw-fastening parts. For example, the conductive parts 5 may be projections formed in at least one of the case body 3 and the case lid 4. Further, the conductive parts 5 may be conductive inclusions such as conductive gaskets partially disposed between the case body 3 and the case lid 4.

The conductive parts 5 as described above are formed at a plurality of places between the circumferential edges of the case lid 4 and the end surfaces (joint surfaces 320) of the side plate portions 32 of the case body 3. More specifically, as shown in FIG. 2, the conductive parts 5 are disposed at the four corners of the case body 3 and the above described two intersection points between the two straight lines L and the side plate portion 32.

In this embodiment, the case body 3 is made of highly heat-conductive metal such as aluminum. The case body 3 has a rectangular shape when viewed from the side of the opening plane (from the axial direction). The bottom plate portion 31 of the case body 3 is formed with radiating fins 311 projecting in the direction opposite to the opening plane, that is, toward the outside. The case lid 4 is formed of a flat metal plate made, for example, a galvanized steel plate. Accordingly, the inner surface 41 of the case lid 4 is coplanar with the opening plane of the case body 3. The case lid 4 and the case body 3 have approximately the same size and shape when viewed from the side of the opening plane of the case body 3.

As shown in FIG. 4, in this embodiment, the magnetic component 2 housed in the case body 3 is a transformer 201. The transformer 201 includes the coil section 21 constituted of a primary coil 211 and a secondary coil 212 stacked on each other in the axial direction, and a pair of cores 22 disposed so as to sandwich the coil section 21 therebetween in the axial direction.

Although not shown in FIG. 2, the case body 3 houses various electronic and magnetic components constituting the power supply apparatus 1 other than the transformer 201. The electronic and magnetic components including the transformer 201 are fixed to the case body 3.

Figure 5:
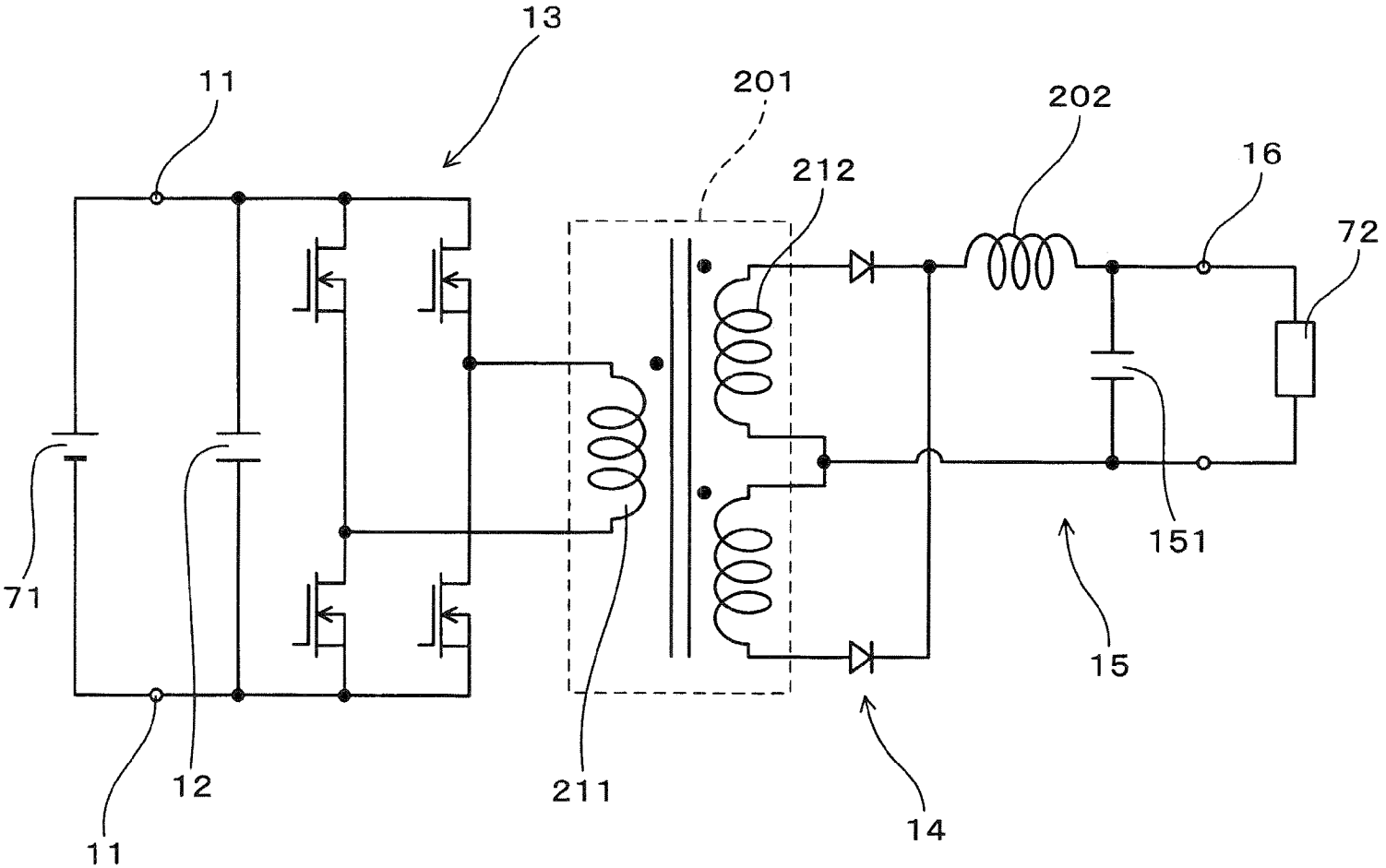
FIG. 5 is a circuit diagram of the power supply apparatus according to the first embodiment.

The power supply apparatus 1 of this embodiment is a DC-DC converter having a circuit structure as shown in FIG. 5. As shown in FIG. 5, the power supply apparatus 1 includes input terminals 11 to be connected to an input-side power source 71 and a switching circuit 13 disposed between the input terminals 11 and the transformer 201. The switching circuit 13 is constituted of a plurality of switching elements for converting an inputted DC power to an AC power. Between the input terminals 11 and the switching circuit 13, a filter capacitor 12 is disposed.

A primary AC voltage outputted from the switching circuit 13 is transformed by the transformer 201.

A rectifier circuit 14 is disposed on the side of the secondary coil 212 of the transformer 201. The rectifier circuit 14 is configured to rectify the secondary voltage outputted from the transformer 201 to a DC voltage as the DC power, and outputs the DC power to an electrical load 72 through output terminals 16. Between the rectifier circuit 14 and the output terminals 16, a filter circuit 15 is disposed. The filter circuit 15 includes a filter capacitor 151 and a choke coil 202.

In this embodiment, although the magnetic component 2 includes the transformer 201 and the choke coil 202, at least the transformer 201 and the conductive parts 5 are disposed so as to satisfy the positional relationship shown in FIG. 2.

The power supply apparatus 1 is configured to step down the voltage of the input-side power source 71 and supply this stepped-down voltage to the electrical load 72. The power supply apparatus 1 can be mounted on an electric vehicle or a hybrid vehicle to be used for charging an auxiliary battery as the electrical load 72 by stepping down the voltage of a drive battery as the input-side power source 71.

The first embodiment described above provides the following advantages. The conductive parts 5 are disposed at the intersection points at which the two straight lines L making the same angle within the range of 45±15 degrees with the perpendicular line N drawn from the center C of the coil section 21 of the magnetic component 2 (the transformer 201) to the closest side plate portion 32 intersect with this closest side plate portion 32 when viewed from the axial direction. This makes it possible to efficiently form eddy currents in the inner surface 41 of the case lid 4 when the magnetic component 2 (the transformer 201) generates a magnetic flux, and prevents the eddy currents from leaking to the outer surface of the case. The eddy currents sufficiently cancel out the magnetic flux to thereby prevent the magnetic flux from leaking outside the case and effectively reduce leakage of electromagnetic noise from the case.

In the following, the reason why the eddy currents can be prevented from leaking according to the structure described above is explained. While the power supply apparatus 1 is in operation, a high-frequency current flows through the magnetic component 2 (the transformer 201), and accordingly a magnetic field is generated. The center of the source of this magnetic field is the center C of the coil section 21, and a magnetic flux flowing in the axial direction is generated. In this state, eddy currents are generated in the inner surface of the bottom plate portion 31 of the case body 3 and the inner surface 41 of the case lid 4 in the direction to cancel out the magnetic flux. The eddy currents flow along concentric circles with the center C of the coil section 21.

Parts of the eddy currents generated in the case body 3, which protrude beyond the bottom plate portion 31 flow to the inner surface of the side plate portion 32 continuing to the bottom plate portion 31. However, parts of the eddy currents generated in the case lid 4, which protrude beyond the inner surface 41 of the case lid 4 pass through the joint surfaces 320 between the case body 3 and the case lid 4. Accordingly, if there is a gap between the case body 3 and the case lid 4 or the electric resistance of the joint surface 320 is high, it would be hard for the eddy currents to flow from the case lid 4 to the case body 3, and the eddy currents would leak to the outer surface of the case.

However, since the electric resistance between the case lid and the case body 3 is low at the conductive parts 5, the eddy currents passing through the conductive parts 5 easily flow from the inner surface 41 of the case lid 4 to the inner surface of the case body 3, and hard to leak outside the case. Accordingly, in the following, to determine how the conductive parts 5 should be disposed, sufficient thought is given to a portion from which the eddy current would leak most if the conductive parts 5 were not provided.

Figure 6:
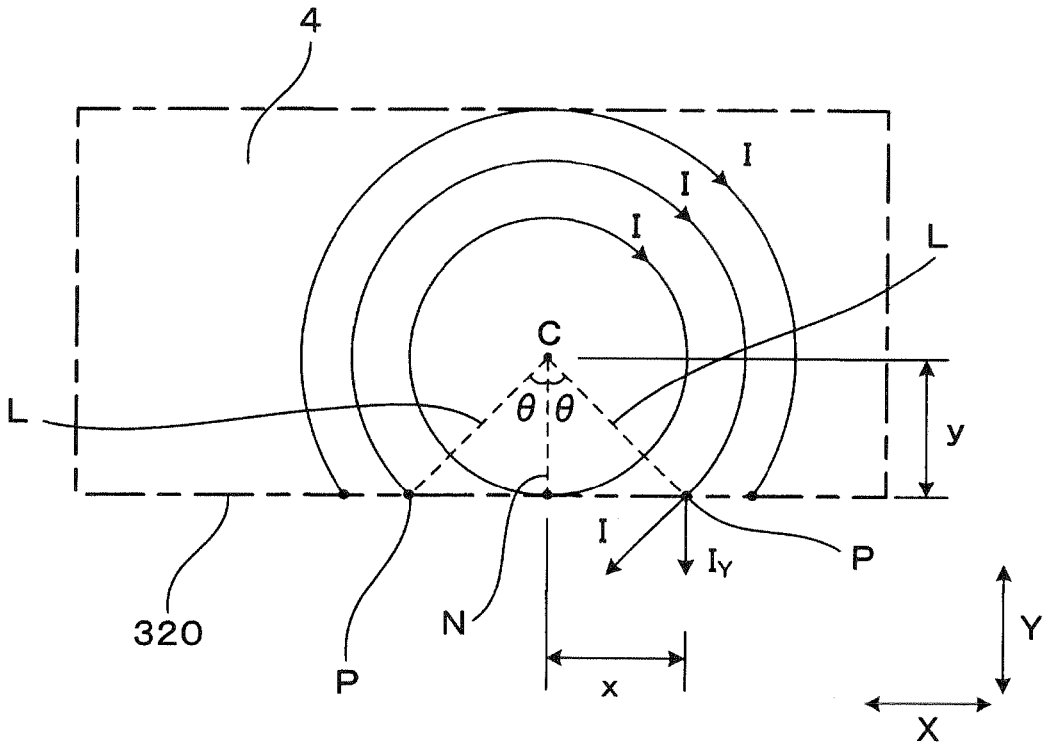
FIG. 6 is an explanatory view explaining eddy currents flowing in the inner surface of a case lid of the power supply apparatus according to the first embodiment.

In this assumption, the portion from which the eddy currents would leak most is a portion at which their components in the direction perpendicular to the side plate portions 32 when viewed from the axial direction (this direction being referred to as the "Y direction", and the direction perpendicular to the Y direction being referred to as the "X direction" hereinafter) are largest. That is, the easiness with which the countless eddy currents I flowing concentrically with the center C as shown in FIG. 6 leak depends on the magnitude and direction of each of the eddy currents I at the joint surface 320. As described above, the eddy current I leaks most at the portion at which its Y-direction component $I_Y$ is largest.

In the following, each position P at which one of the conductive parts 5 should be disposed is considered based on the above premises. Since the magnitude of the eddy current I is inversely proportional to the distance r from the center C, the equation of $I=k/r$ holds, where k is a constant. When the angle which the straight line L connecting the center C and the position P makes with the perpendicular line N is θ, the Y-direction component $I_Y$ of the eddy current I at the position P is given by the equation of $I_Y=I \sin \theta$. Accordingly, the equation of $I_Y=(k/r)$ sine holds.

Further, when the distances along the X direction and the Y direction between the center C and the position P is x and y, respectively, the equation of $r=y/\cos \theta$ holds. Accordingly, the component $I_Y$ is given by the equation of $I_Y=(k/y)\sin \theta \cos \theta=(k/2y)\sin 2\theta$. Since k is a constant and the position of the magnetic component 2 is fixed, y is also a constant. Therefore, the component $I_Y$ takes its maximum when θ=45 degrees. Accordingly, each of the intersection points between the straight lines L and the joint surface 320 (side plate portion 32) when θ=45 degrees can be regarded as a point at which the eddy current would leak most easily if the conductive parts are not provided. Hence, by disposing the conductive parts 5 at these points, the eddy currents can be most effectively prevented from leaking and the electromagnetic noise can be most effectively prevented from being emitted.

Figure 7:
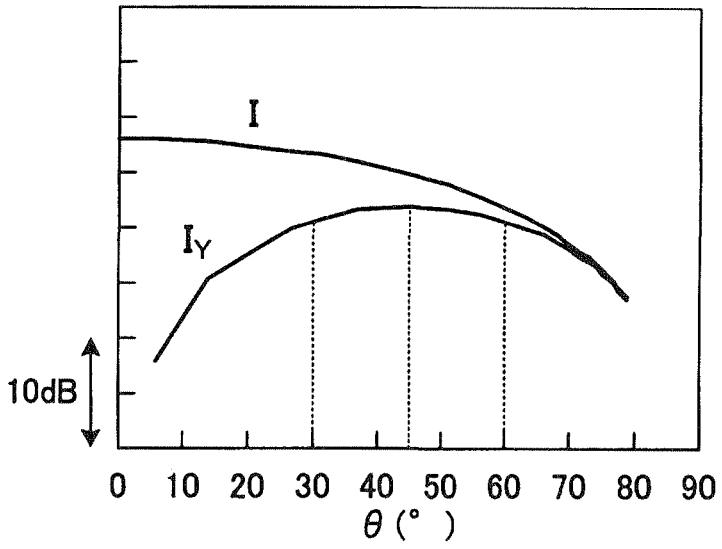
FIG. 7 is a graph showing relationships of the eddy current I and its Y-direction component $I_Y$ (see FIG. 6) to the angle θ when the distance y=20 mm.
Figure 8:
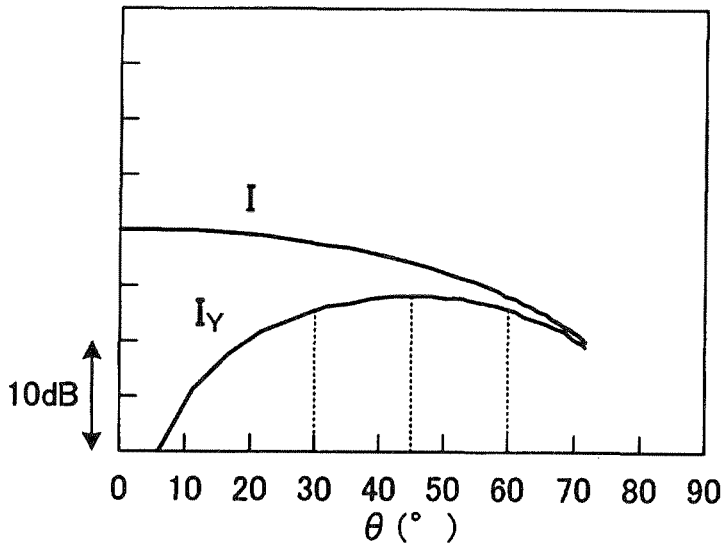
FIG. 8 is a graph showing relationships of the eddy current I and its Y-direction component $I_Y$ (see FIG. 6) to the angle θ when the distance y=50 mm.
Figure 9:
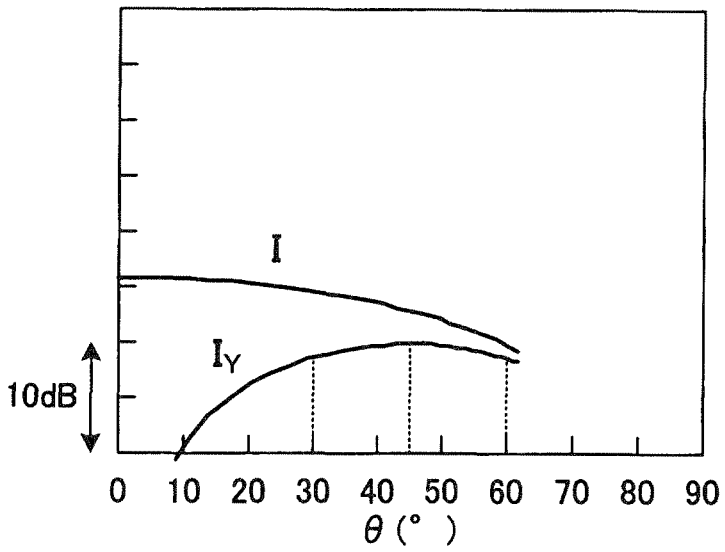
FIG. 9 is a graph showing relationships of the eddy current I and its Y-direction component $I_Y$ (see FIG. 6) to the angle θ when the distance y=80 mm.

FIGS. 7 to 9 are graphs showing the results of simulation of relationships of the magnitude of the eddy current I and its Y-direction component $I_Y$ to the angle θ for the cases where y is 20 mm, 50 mm and 80 mm. In each of the graphs, the horizontal axis represents the angle θ, and the vertical axis represents the magnitudes in dB of the eddy current I and its Y-direction component. Two divisions of the vertical axis correspond to 10 dB.

As seen from FIGS. 7 to 10, the Y-direction component $I_Y$ takes is maximum value when θ=45 degrees. However, the amount of reduction of the magnitude of the Y-direction component $I_Y$ from its maximum value does not exceed 1 dB if the angle θ is within the range from 30 to 60 degrees. Accordingly, by disposing the conductive parts 5 at positions satisfying the condition that the angle θ is within 45±15 degrees, it is possible to effectively suppress leakage of the eddy currents.

As described above, according to the first embodiment of the invention, there is provided a power supply apparatus capable of effectively suppressing leakage of electromagnetic noise.

Second Embodiment

Figure 10:
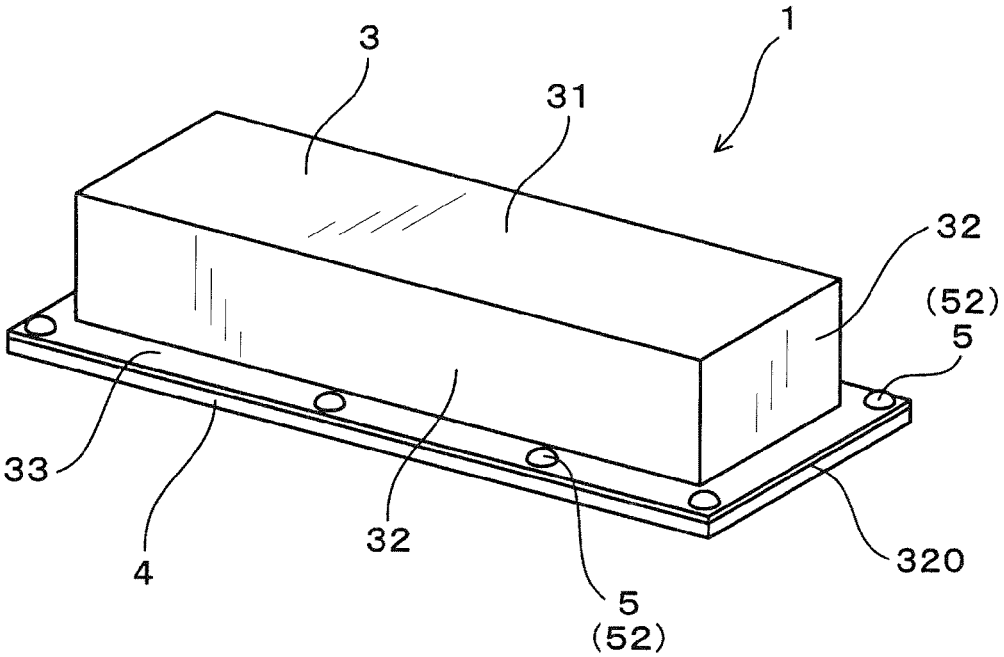
FIG. 10 is a perspective view of a power supply apparatus according to a second embodiment of the invention.
Figure 11:
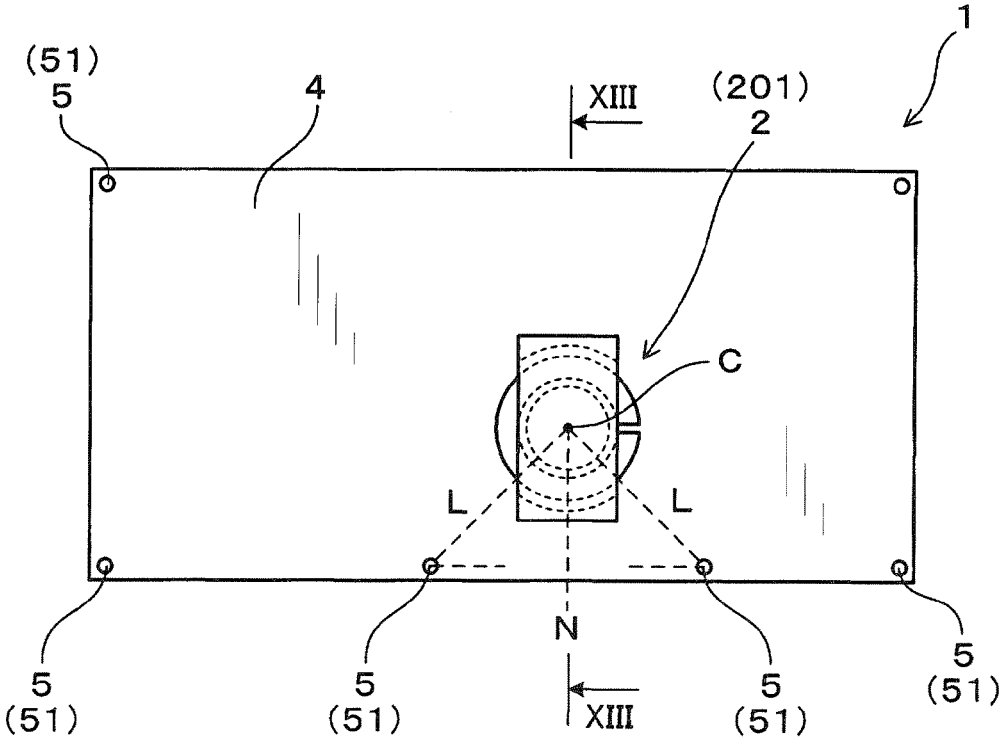
FIG. 11 is a plan view showing a positional relationship between the case body of the power supply apparatus according to the second embodiment and a magnetic component housed therein.
Figure 12:
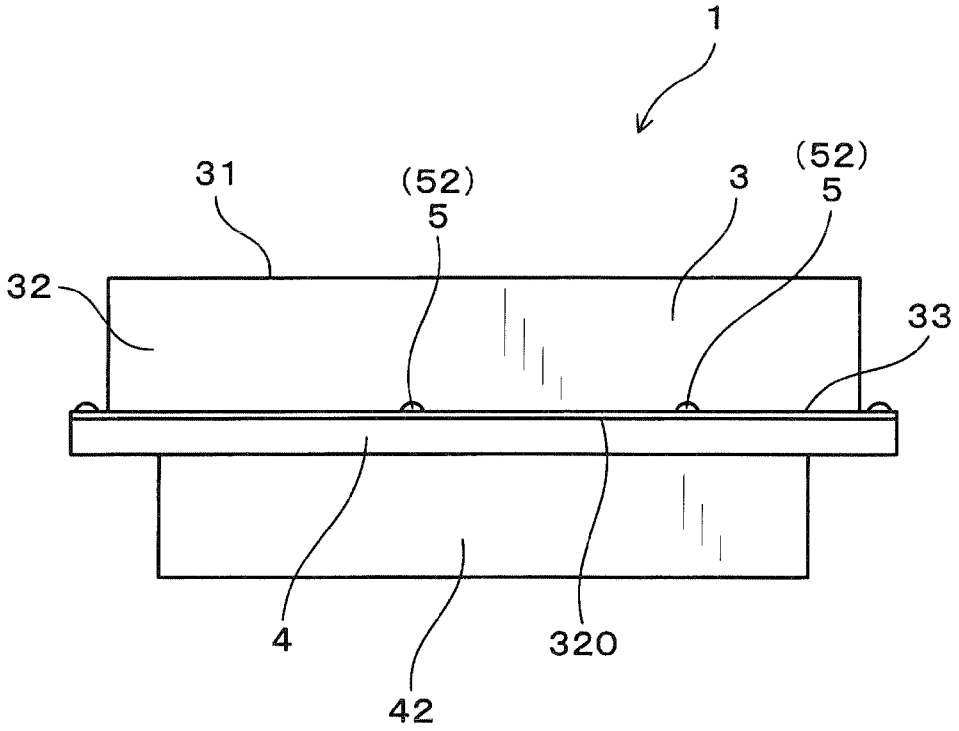
FIG. 12 is a side view of the power supply apparatus according to the second embodiment.
Figure 13:
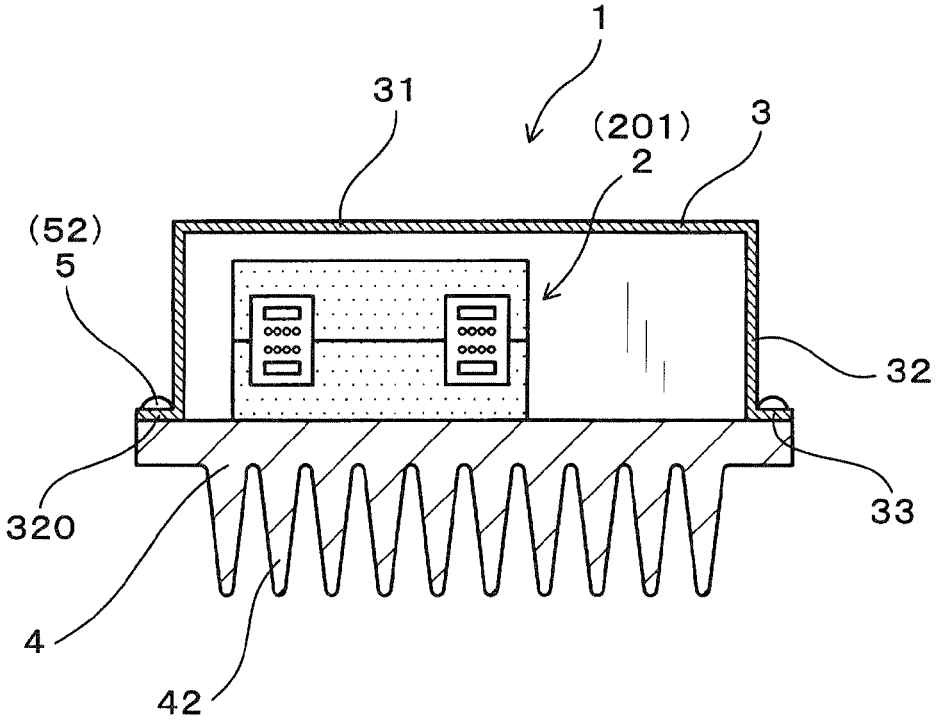
FIG. 13 is a cross-sectional view taken along line XIII-XIII in FIG. 11.

Next, a second embodiment of the invention is described with reference to FIGS. 10 to 13. As shown in FIGS. 10 to 13, in the second embodiment, magnetic components including the transformer 201 and electronic components are mounted on the case lid 4. In this embodiment, the case lid 4 is made of metal having a good heat conductivity such as aluminum and formed with radiating fins 42 as shown in FIGS. 12 and 13.

On the other hand, the case body 3 is made of a galvanized steel sheet. The case body 3 includes the bottom plate portion 31, and a plurality of the side plates 32 standing from the circumferential edges of the bottom plate portion 31 toward the side of the opening plane.

The case body 3 further includes a flange portion 33 formed so as to project outward from the side plate portions 32 at the opening plane. The flange portion 33 is formed with insertion holes 33 through which the male screws 52 pass. As shown in FIG. 11, the female screws 51 to be engaged with the male screws 52 are formed in the case lid 4. As shown in FIGS. 10, 12 and 13, the case body 3 and the case lid 4 are fastened to each other at the flange portion 32 by engaging the male screws 52 with the female screws 51. In this embodiment, the screw-fastening parts serve as the conductive parts 5 like in the first embodiment.

As shown in FIG. 11, the positions of the conductive parts 5 are at the four corners of the case body 3, and at the intersection points between the foregoing two straight lines L and the side plate portion 32 as is the case with the first embodiment. Except for the above, the second embodiment is the same in structure as the first embodiment. According to the second embodiment, there is provided a power supply apparatus capable of effectively suppressing leakage of electromagnetic noise like the first embodiment.

Third Embodiment

Figure 14:
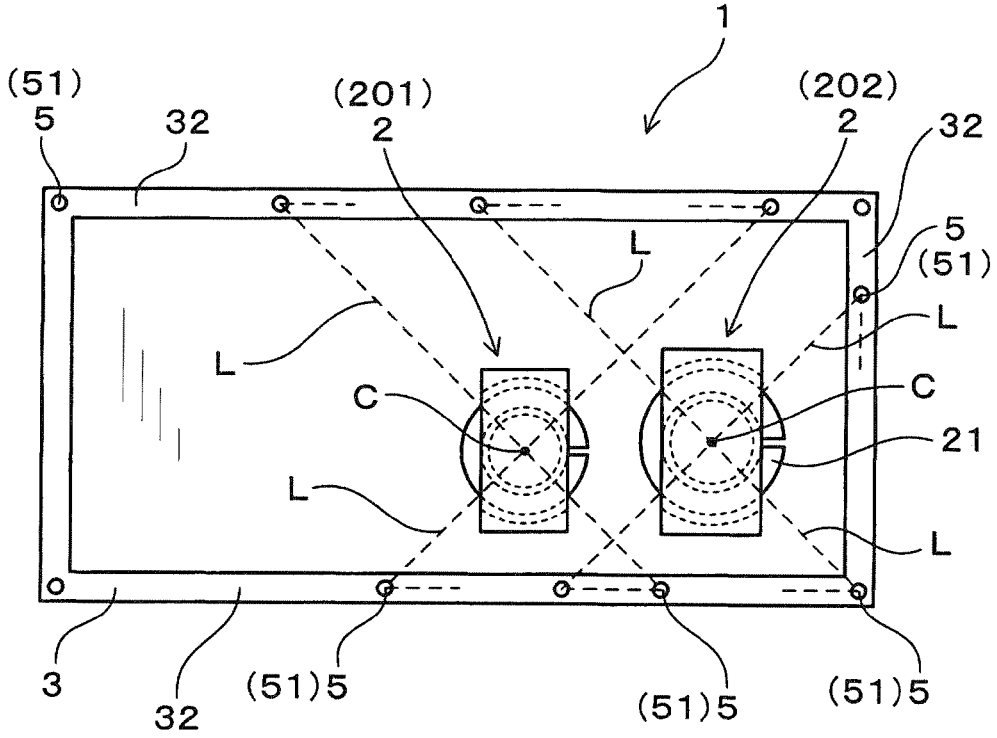
FIG. 14 is a plan view showing a positional relationship between the case body of a power supply apparatus according to a third embodiment of the invention and magnetic components housed therein.

Next, a third embodiment of the invention is described with reference to FIG. 14. As shown in FIG. 14, in the third embodiment, the conductive parts 5 are disposed at positions effective in suppressing leakage of the electromagnetic noise taking into consideration the positions of two magnetic components 2. That is, the conductive parts 5 are disposed at the intersection points at each of which one of the two straight lines L making the same angle within the range of 45±15 degrees with a corresponding one of the perpendicular lines N each drawn from the center C of a corresponding one of the two magnetic components 2 to the side plate portions 32 intersects with these side plate portions 32 when viewed from the axial direction.

In this embodiment, the conductive parts 5 are disposed at the intersection points at which each of the straight lines L intersect with not only the closest side plate portion 32 but all the side plate portions 32. Incidentally, in this embodiment, since the straight lines L do not intersect with one of the side plate portions (the side plate portion 32 at the left side in FIG. 14), the conductive parts 5 are not disposed on this one side plate portion 32 except the corners of the case body 3.

In this embodiment, the conductive parts 5 are disposed only at the above intersection points and at the four corners of the case body 3. That is, in this embodiment, the conductive parts 5 provided corresponding to each of the two magnetic parts 2 are four in number. In addition, the conductive part 5 is provided at each of the four corners of the case body 3. However, one of the four conductive parts 5 provided at the four corners of the case body 3 doubles as the conductive part 5 provided for one of the two magnetic components 2. Hence, the total number of the conductive parts 5 in this embodiment is 11.

One of the two magnetic components 2 is the transformer 201, and the other is the choke coil 202. Except for the above, the third embodiment is the same in structure as the first embodiment.

According to this embodiment, it is possible to effectively suppress leakage of the eddy currents generated in accordance with the magnetic fluxes generated from a plurality of the magnetic components. Further, according to this embodiment, it is possible to suppress leakage of the eddy currents not only at the joint surface 320 between the side plate portion 32 closest to the noise source and the case lid 4 but also the other joint surfaces 320. Hence, according to this embodiment, leakage of the electromagnetic nose can be effectively suppressed.

Fourth Embodiment

Figure 15:
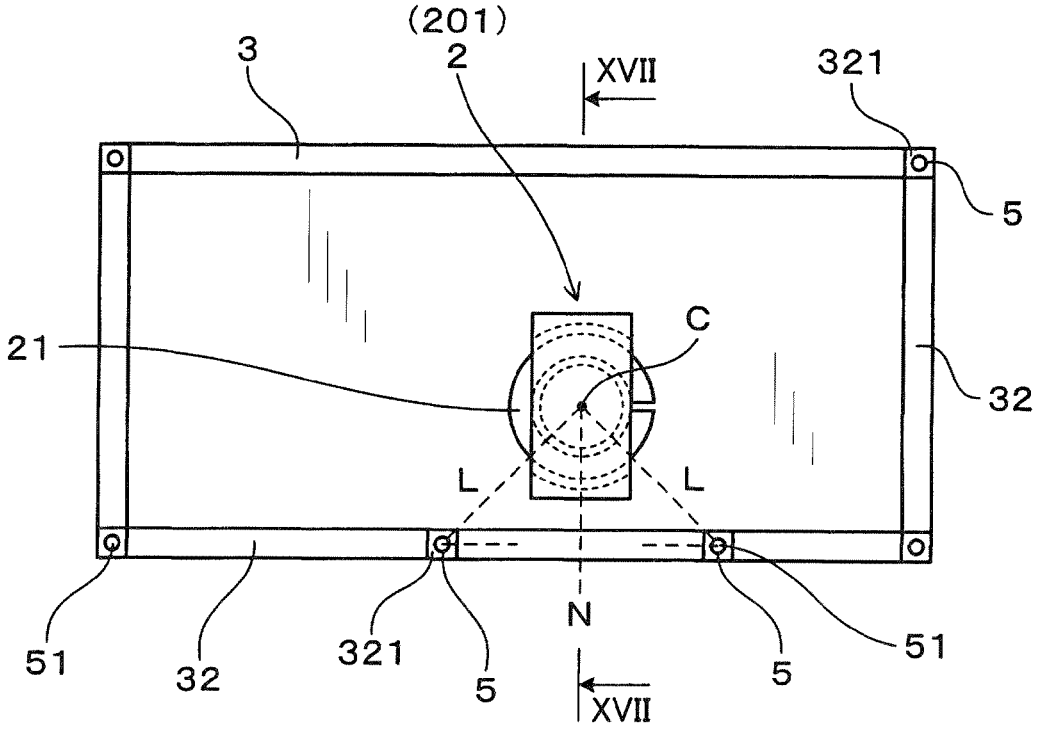
FIG. 15 is a plan view showing a positional relationship between the case body of a power supply apparatus according to a fourth embodiment of the invention and a magnetic component housed therein.
Figure 16:
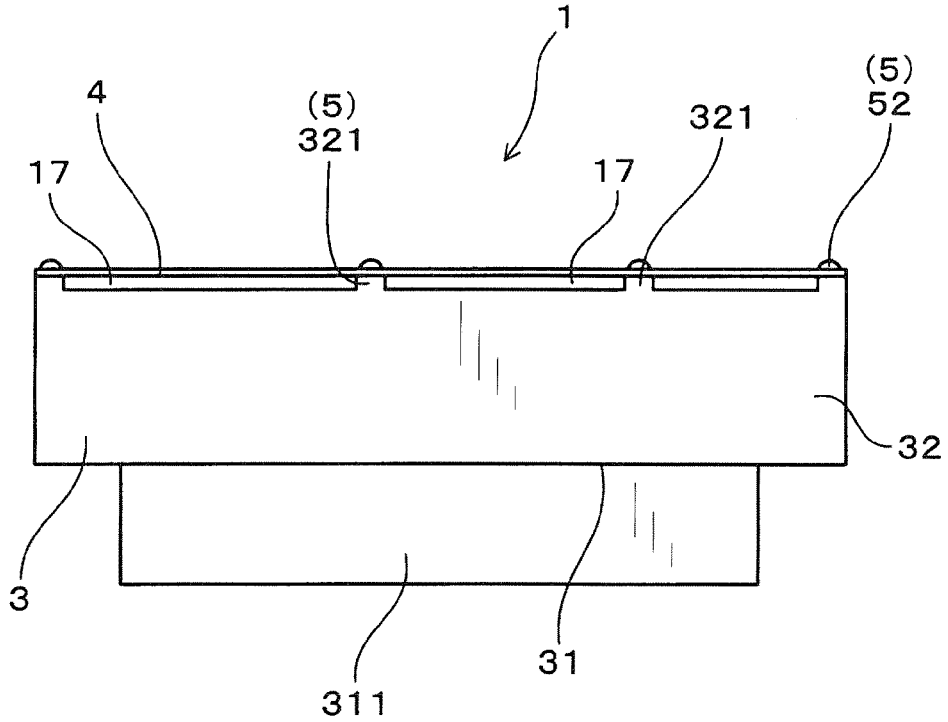
FIG. 16 is a side view of the power supply apparatus according to the fourth embodiment.
Figure 17:
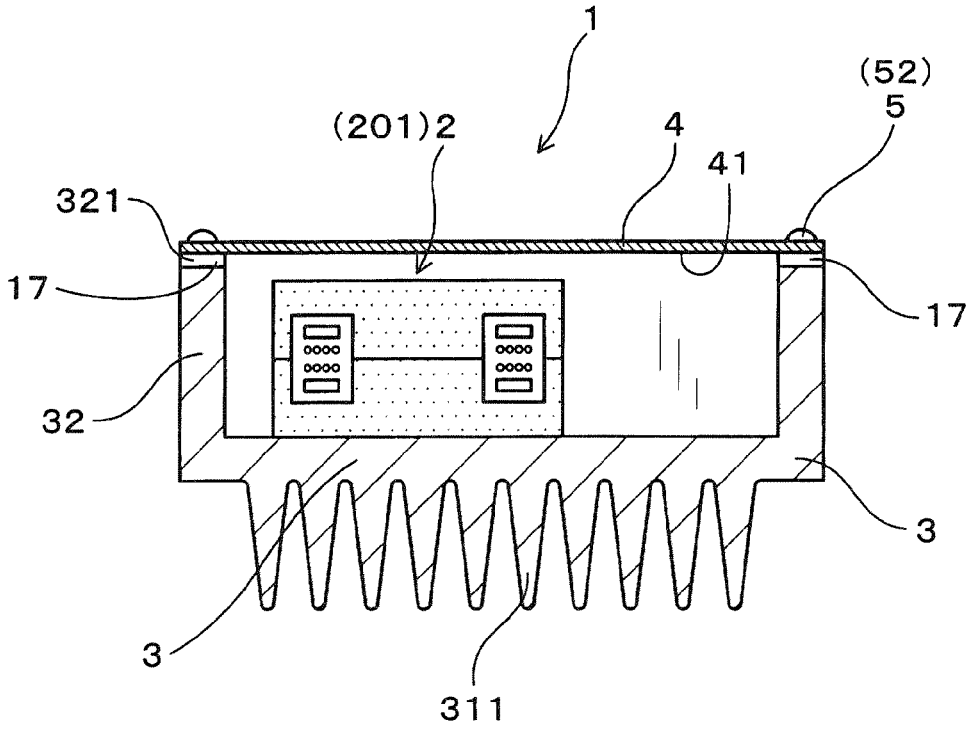
FIG. 17 is a cross-sectional view taken along line XVII-XVII in FIG. 15.

Next, a fourth embodiment of the invention is described with reference to FIGS. 15 to 17. As shown in FIGS. 15 to 17, in the fourth embodiment, projections 321 are formed in the end surfaces of the side plate portions 32 of the case body 3. Each of the projections 321 is formed with the female screw 51. That is, the case lid 4 is fastened to the case body 3 at the projections 321 by engaging the male screws 52 with the female screws 51. The case lid 4 contacts with the case body 3 only at the projections 321, and gaps 17 are present between the case body 3 and the case lid 4 at portions not formed with the projection 321. Hence, in this embodiment, the portions formed with the projections 321 serve as the conducting parts 5. Forming the gaps 17 between the case body 3 and the case lid 4 makes it possible to dissipate heat from the inside of the case by convection. Except for the above, the fourth embodiment is the same in structure as the first embodiment.

According to the fourth embodiment, it is possible to increase the heat radiating performance of the power supply apparatus 1. That is, according to the fourth embodiment, it is possible to effectively suppress leakage of the electromagnetic noise while ensuring a good heat radiation property.

Fifth Embodiment

Figure 18:
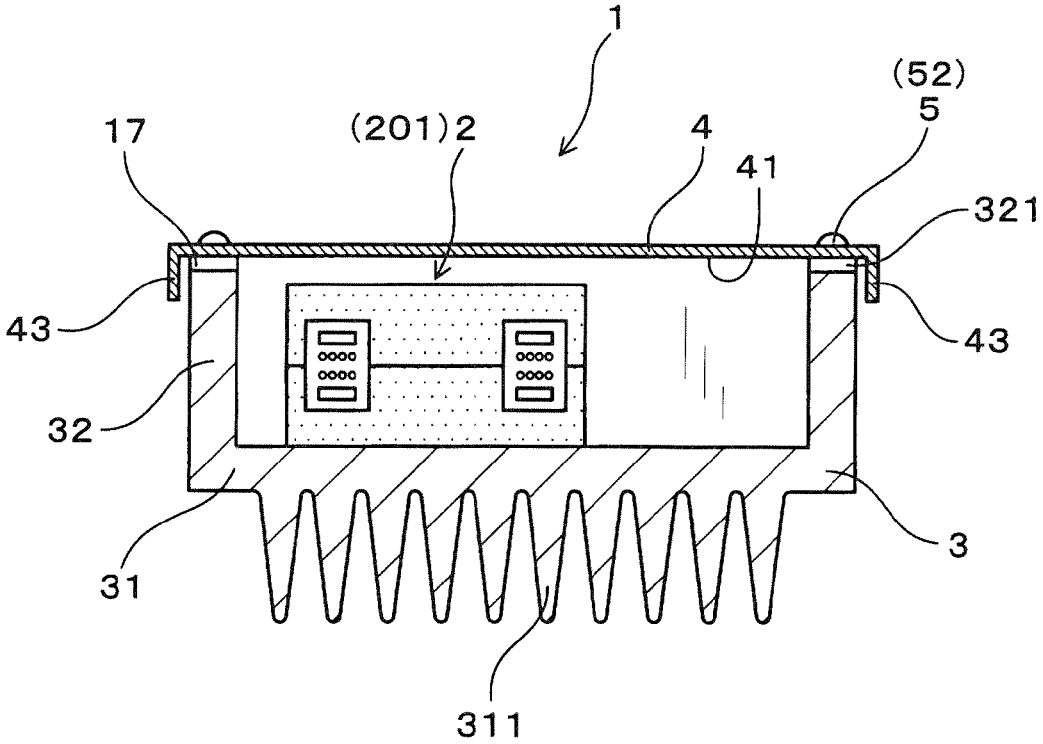
FIG. 18 is a cross-sectional view of a power supply apparatus according to a fifth embodiment of the invention.
Figure 19:
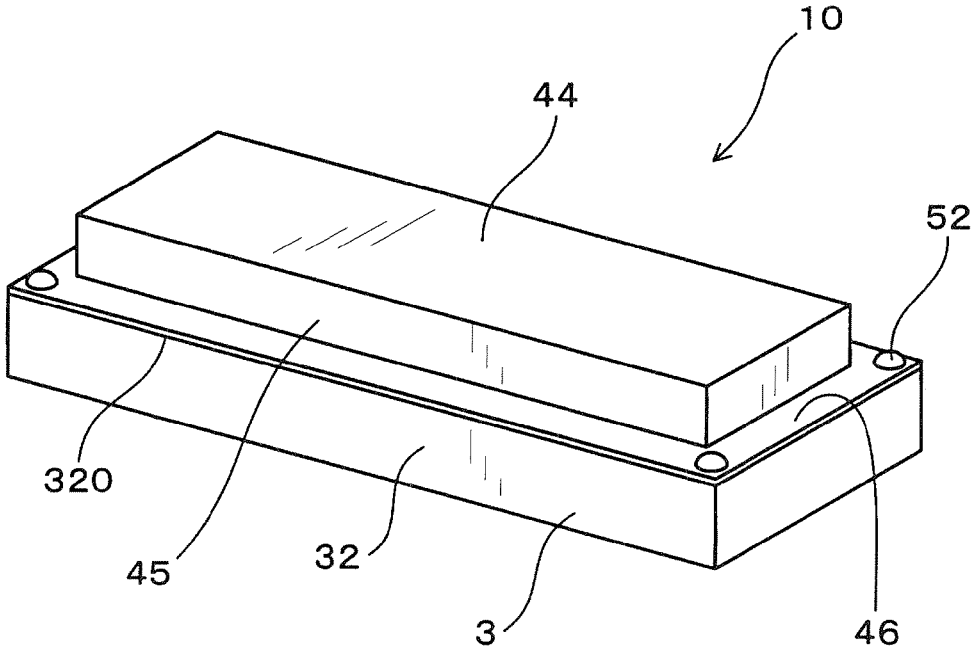
FIG. 19 is a perspective view of a power supply apparatus according to a sixth embodiment of the invention.
Figure 20:
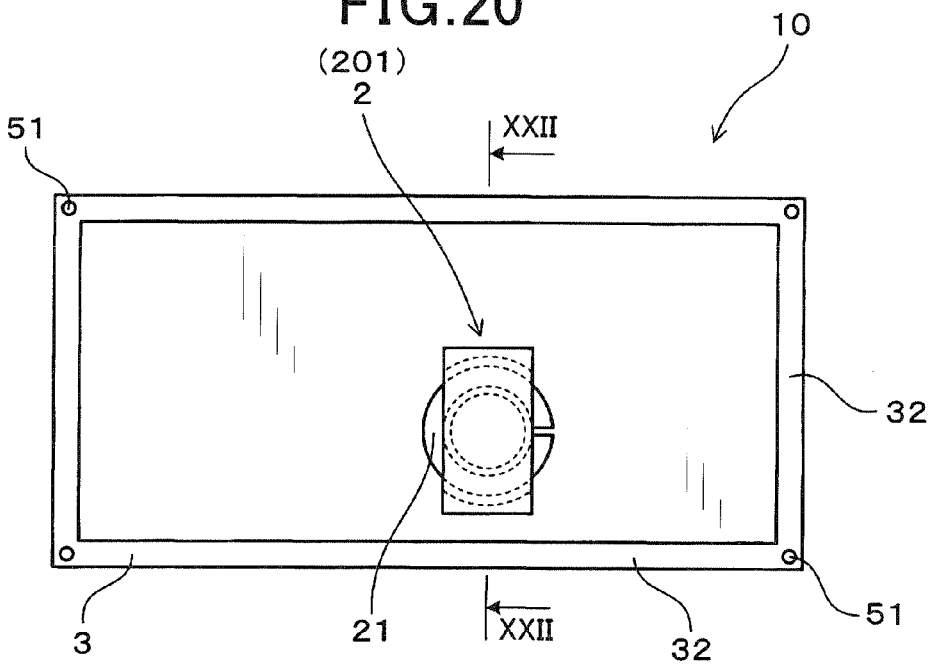
FIG. 20 is a plan view showing a positional relationship between the case body of the power supply apparatus according to the sixth embodiment and a magnetic component housed therein.
Figure 21:
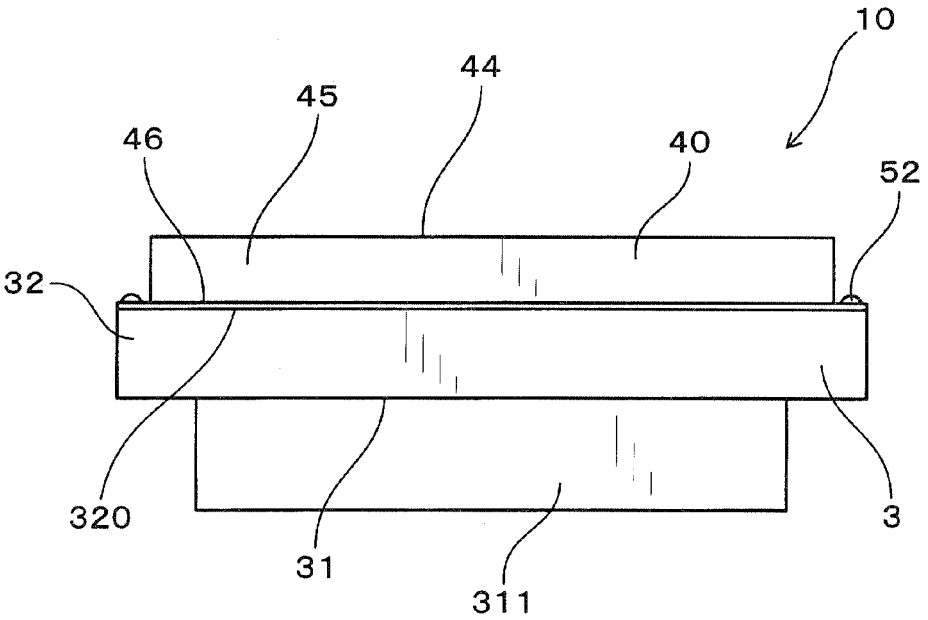
FIG. 21 is a side view of the power supply apparatus according to the sixth embodiment.
Figure 22:
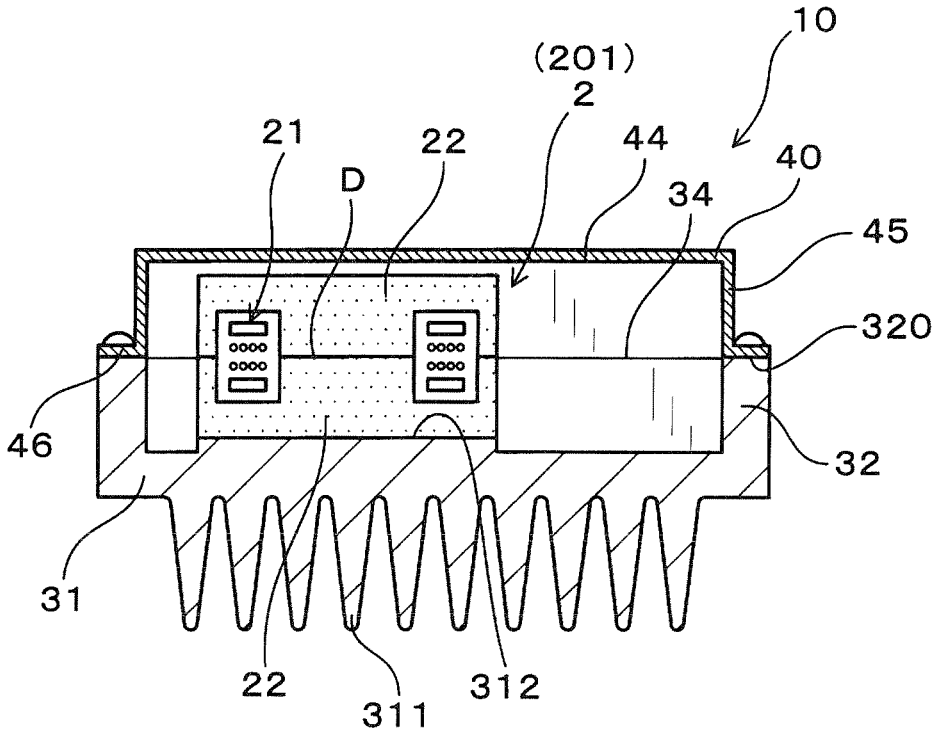
FIG. 22 is a cross-sectional view taken along line XXII-XXII in FIG. 20.

Next, a fifth embodiment of the invention is described with reference to FIG. 18. In the fifth embodiment, as shown in FIG. 18, the case lid 4 includes a standing portion 43 formed so as to stand from the circumferential edges thereof toward the case body 3. The standing portion 43 is located outward of the side plate portions 32 of the case body 3 so as to cover the gaps between the end surfaces of the side plate portions 32 and the inner surface 41 of the case lid 4. However, small gaps are provided between the standing portion 43 and the side-plate portions 32 so that air passages through the gaps 17 are not closed.

Preferably, the standing portion 43 is formed throughout the circumference of the case lid 4, and is larger in the standing direction than the gaps 17. Except for the above, the fifth embodiment is the same in structure as the fourth embodiment.

According to this embodiment, since the standing portion 43 is provided, leakage of the electromagnetic noise can be suppressed more effectively.

Sixth Embodiment

Next, a power supply apparatus 10 according to a sixth embodiment of the invention is described with reference to FIGS. 19 to 25. As shown in FIGS. 19 to 25, in this embodiment, the positional relationship in the axial direction between the axial center D of the magnetic component 2 and the opening plane 34 of the case body 3 is specified. The power supply apparatus 10 according to this embodiment includes the magnetic component 2, the case body 3 and a case lid 40. Unlike the case lid 4 of the first embodiment, the case lid 40 of this embodiment includes a plurality of vertical plate portions 45 which extends down from its top plate portion 44 toward the case body 3.

The case lid 40 includes a flange portion 46 projecting outward from the ends of the vertical plate portions 46. The case lid 40 is fastened to the case body 3 at this flange portion 46 by the male screws 52. In this embodiment, the screw-fastening parts are only at the four corners of the case body 3. The positions of the screw-fastening parts are not limited to any specific places. However, unlike the first embodiment, the positions of the screw-fastening parts are not limited to any specific places.

Figure 23:
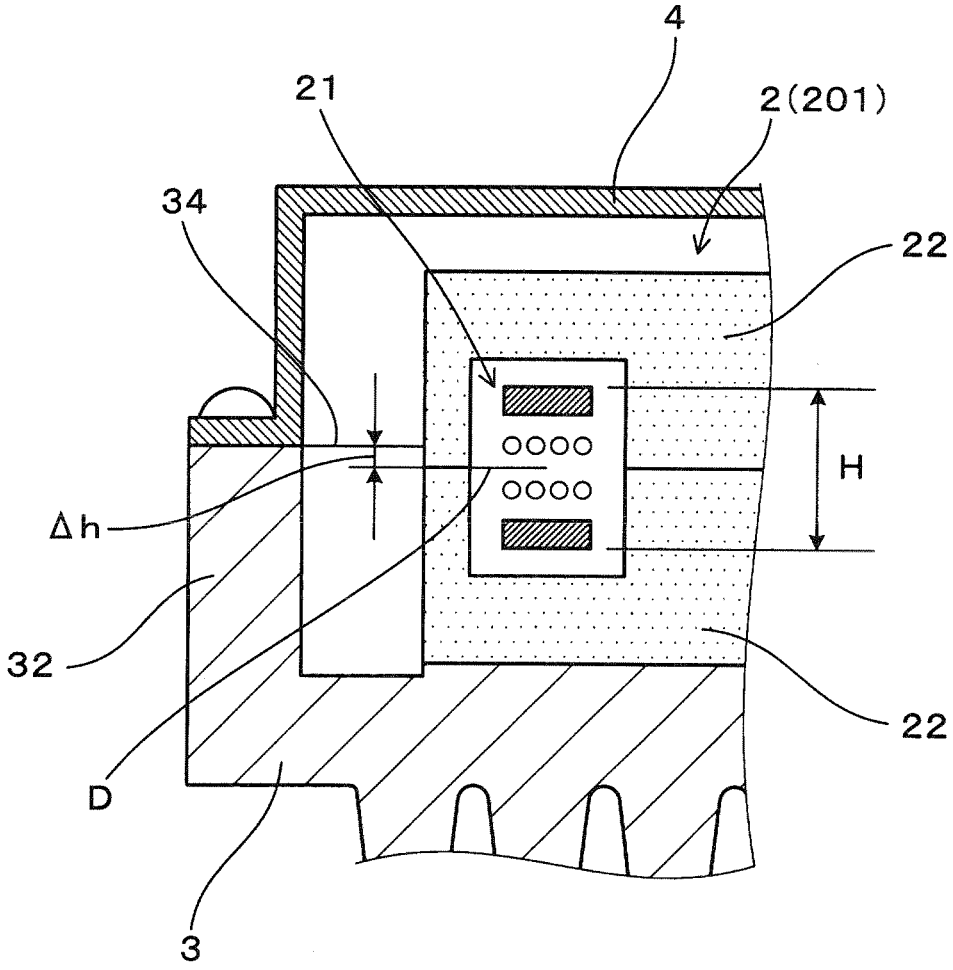
FIG. 23 is a cross-sectional view showing an axial positional relationship between the case body of the power supply apparatus according to the sixth embodiment and magnetic components housed therein.

When the axial dimension of the coil section 21 of the magnetic component 2 is H, and the difference in axial position between the center D of the coil section 21 and the opening plane 34 is Δh as shown in FIG. 23, the relationship of $\Delta h/H \leq 0.25$ is satisfied. Incidentally, since the joint surfaces 320 between the case body 3 and the case lid 40 are coplanar with the opening plane 34, the difference in axial position between the center D of the coil section 21 and the opening plane 34 is the same the difference in axial position between the center D of the coil section 21 and the joint surfaces 320.

In this embodiment, the relationship of $\Delta h/H \leq 0 = 0.25$ is satisfied for the transformer 201 as the magnetic component 2. That is, the axial position of the center D of the coil section 21 is approximately the same as the opening plane 34. However, there may be a slight difference smaller than Δh between their axial positions, if the relationship of $\Delta h/H \leq 0.25$ is satisfied.

The case body 3 is formed with a mounting portion for mounting the magnetic component 2 thereon, the position of the mounting portion being adjusted for adjusting the axial center D of the coil section 21. In this embodiment, the mating surface of a pair of the cores 22 of the magnetic component 2 (the transformer 201) agrees with the axial center D of the coil section 21. Except for the above, the sixth embodiment is the same in structure as the first embodiment.

The sixth embodiment described above provides the following advantages. The power supply apparatus 10 according to this embodiment satisfies the positional relationship of $\Delta h/H \leq 0.25$. This makes it possible to efficiently generate eddy currents in the inner surfaces of the case lid 40 and the case body 3 when magnetic flux is generated from the magnetic component 2, and to effectively suppress the eddy currents from leaking to the outer surface of the case. Since the eddy currents sufficiently cancel out the magnetic flux to prevent the magnetic flux from leaking outside the case, the electromagnetic noise can be prevented from leaking.

In the following, the reason why the eddy currents can be prevented from leaking according to the structure of this embodiment described above is explained. While a high-frequency current flows through the magnetic component 2 (the transformer 201), a magnetic field is generated. The center of the source of this magnetic field is the center C of the coil section 21 (see FIG. 20), and the magnetic flux flows in the axial direction. In this state, eddy currents are generated in the inner surface of the bottom plate portion 31 of the case body 3 and the inner surface 41 of the case lid 40 in the direction to cancel out the magnetic flux. The eddy currents I flow along concentric circles with the center C of the coil section 21.

Figure 24:
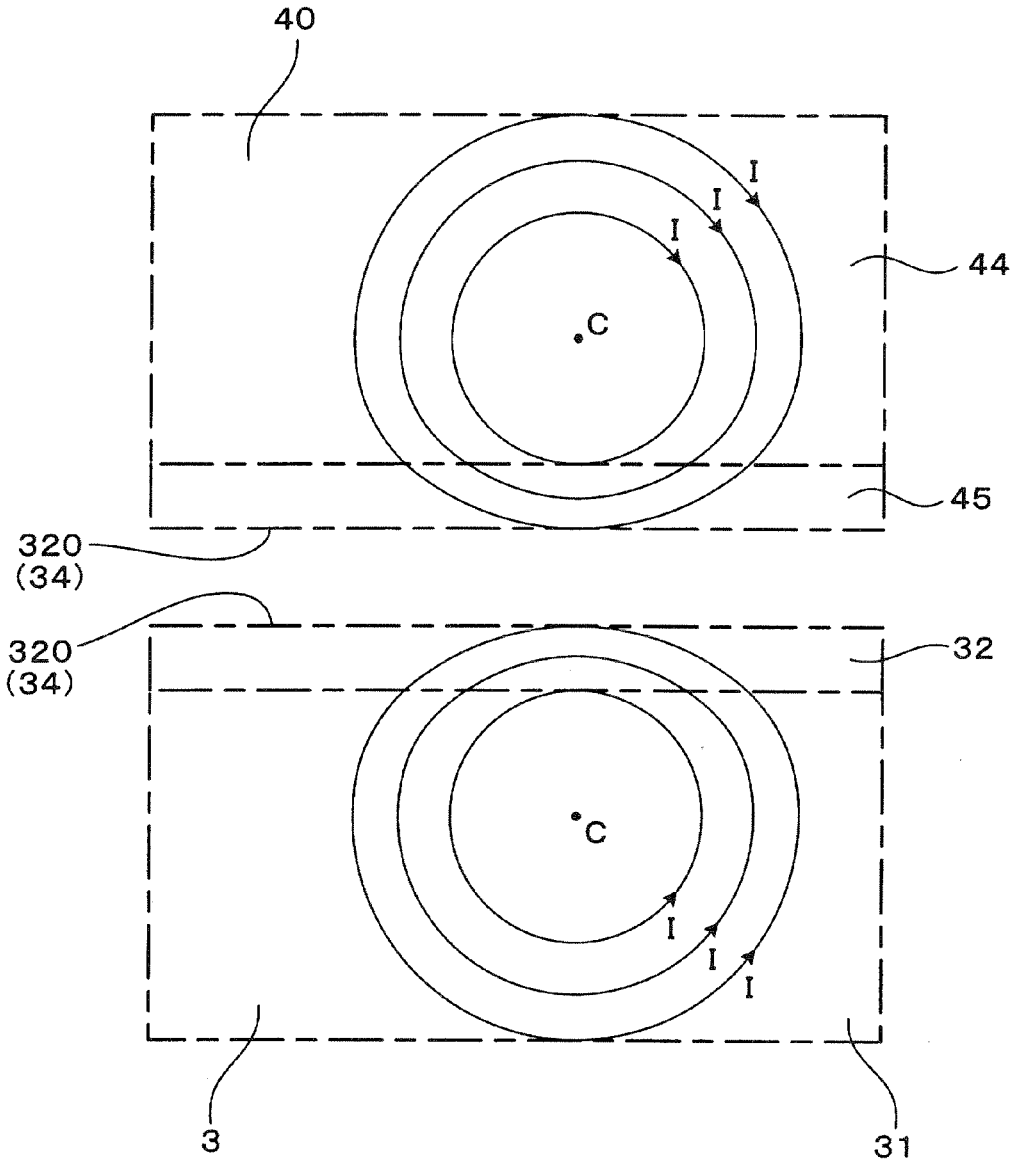
FIG. 24 is an explanatory view explaining eddy currents flowing in the inner surfaces of the case lid and the case body of the power supply apparatus according to the sixth embodiment.

The upper rectangle shown by a chain line in FIG. 24 shows a developed state of the top plate portion 44 and one of the vertical plate portions 45 of the case lid 40. The lower rectangle shown by a chain line in FIG. 24 shows a developed state of the bottom plate portion 31 and one of the side plate portions 32 of the case body 3.

As shown in FIG. 24, part of the eddy currents generated in the inner surface of the case body 3 and part of the eddy currents generated in the inner surface of the case lid 40, which protrude beyond the bottom plate portion 31 or the top plate portion 44 flow to the side plate portion 32 or the vertical plate portion 45. The eddy currents partially flowing to the side plate portion 32 or to the vertical plat portion 45 include an axial component (a component in the direction in which the case body 3 and the case lid 4 are stacked on each other). The eddy currents I leak more from the joint surfaces 320 to the outside of the case, when the axial component at the joint surfaces (a component in the direction perpendicular to the joint surfaces 320 and the opening plane 34) is more.

However, the axial component of the eddy currents I in the side plate portions 32 and that of the axial component of the eddy currents I in the vertical plate portions 45 are opposite in direction to each other for the same axial position. When, the position of the joint surfaces 320 between the side plate portions 32 and the vertical plate portions 45 (or the position of the opening plane 34 of the case body 3) agrees with the axial center D (see FIG. 23) of the coil section 21, the eddy currents I in the side plate portions 32 and the eddy currents I in the vertical plate portions 45 cancel out with each other for their axial components. Hence, the eddy currents I can be suppressed from leaking from the joint surfaces 320 to thereby suppress leakage of the electromagnetic noise.

Figure 25:
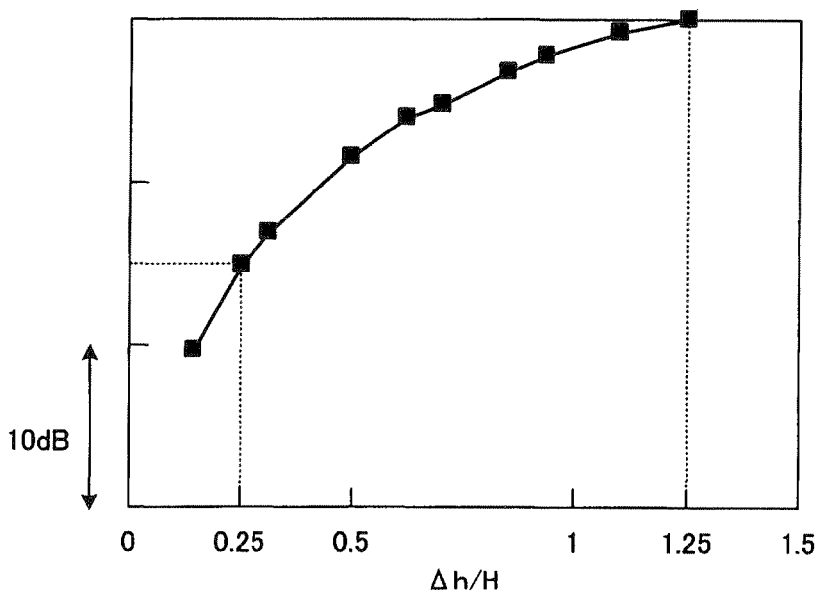
FIG. 25 is a graph showing a relationship of the magnitude of electromagnetic noise leaking outside from the power supply apparatus according to the sixth embodiment to $\Delta h/H$.

FIG. 25 is a graph showing the result of simulation how the magnitude of the leaking electromagnetic noise varies when the Δh/H is varied within the range from 0 to 1.25. In this graph, the vertical axis represents Δh/H (one division corresponding to 10 dB) and the horizontal axis represents the magnitude of the leaking electromagnetic noise. Incidentally, when $\Delta h/H = 0$, since the magnitude of the leaking electromagnetic noise is extremely small, the value is not plotted in this graph.

As seen from the graph of FIG. 25, by setting Δh/H smaller than or equal to 0.25, a noise reduction greater than 15 dB from when the $\Delta h/H=1.25$ can be obtained. That is, by setting $\Delta h/H$ smaller than or equal to 0.25, it becomes possible to substantially reduce leakage of the electromagnetic noise for the case where the axial center D of the coil section 21 deviates from the opening plane 34 by a half of the axial dimension H of the coil section 21. As understood from the above, by satisfying the relationship of $\Delta h/H \leq 0.25$, the electromagnetic noise can be effectively suppressed.

Hence, according to the sixth embodiment, there is provided a power supply apparatus capable of effectively suppressing leakage of electromagnetic noise.

Seventh Embodiment

Figure 26:
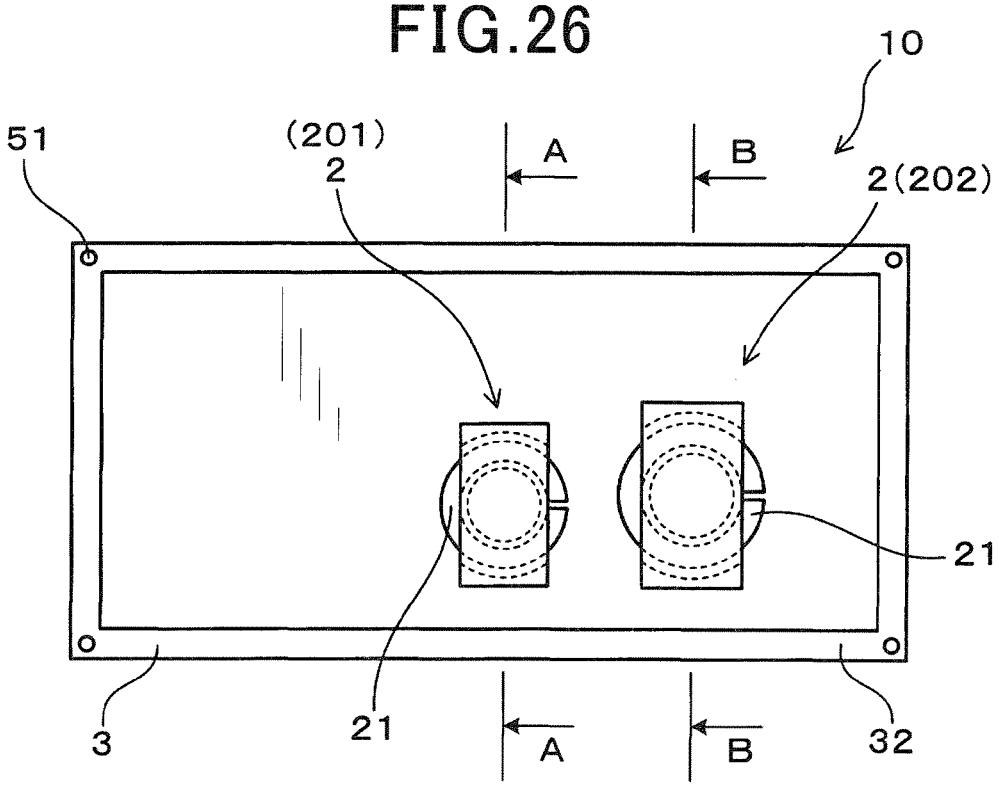
FIG. 26 is a plan view showing a positional relationship between the case body of a power supply apparatus according to a seventh embodiment of the invention and magnetic components housed therein.
Figure 27A:
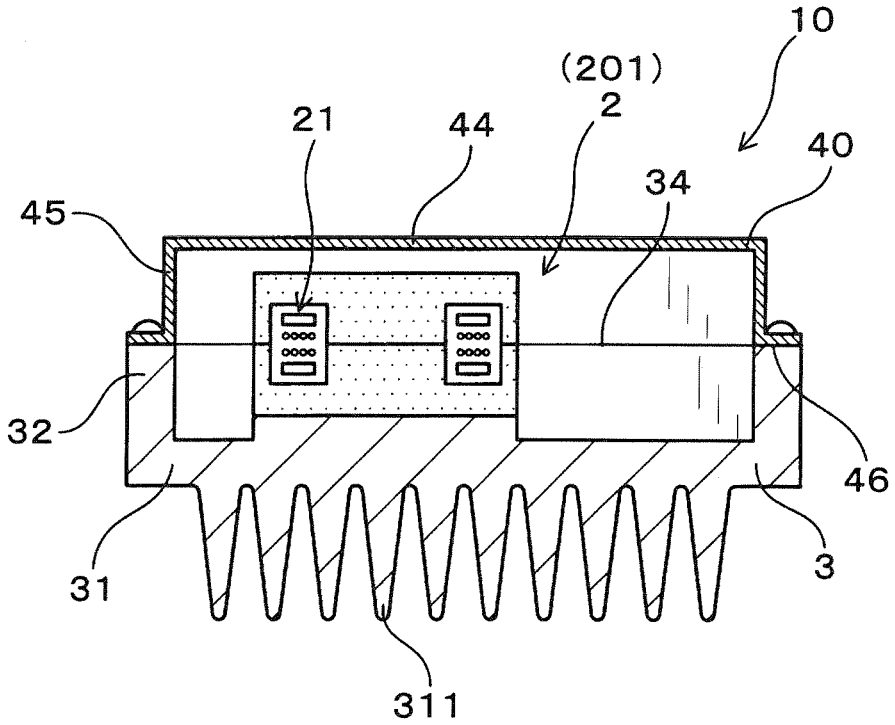
FIG. 27A is a cross-sectional view taken along line A-A in FIG. 26.
Figure 27B:
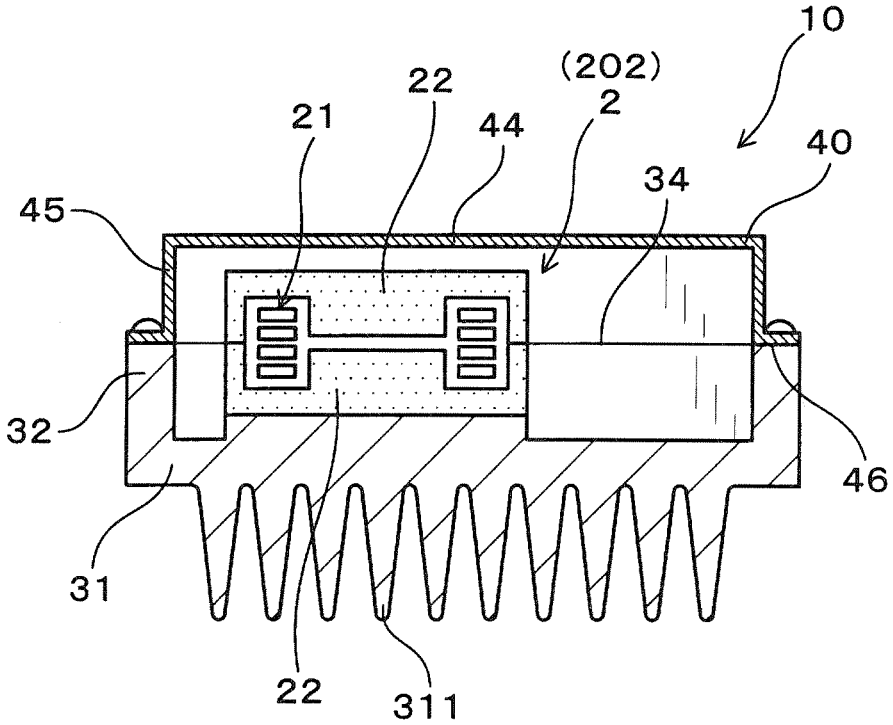
FIG. 27B is a cross-sectional view taken along line B-B in FIG. 26

Next, a power conversion apparatus 10 according to a seventh embodiment of the invention is described with reference to FIGS. 26, 27A and 27B. As shown in FIGS. 26, 27A and 27B, in this embodiment, the two magnetic components 2 are disposed so as to satisfy the relationship of $\Delta h/H \leq 0.25$. The two magnetic components 2 may be the transformer 201 and the choke coil 202.

As shown in FIGS. 27A and 27B, for each of the two magnetic components 2, the axial center D of the coil section 21 is located at a position axially close to the opening plane 34 so that the relationship of $\Delta h/H \leq 0.25$ is satisfied. Except for the above, the seventh embodiment is the same in structure as the sixth embodiment.

According to this embodiment, it is possible to effectively suppress leakage of the eddy currents generated in accordance with the magnetic fluxes generated from the two magnetic components to thereby suppress leakage of the electromagnet noise more effectively.

Eighth Embodiment

Figure 28:
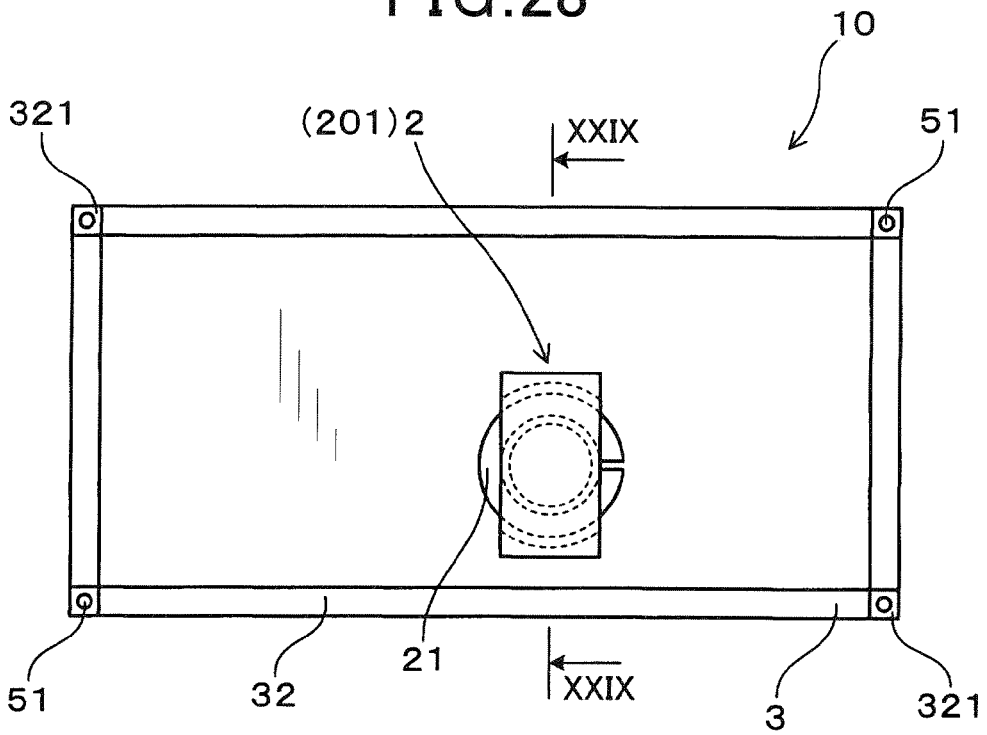
FIG. 28 is a plan view showing a positional relationship between the case body of a power supply apparatus according to an eighth embodiment of the invention and a magnetic component housed therein.
Figure 29:
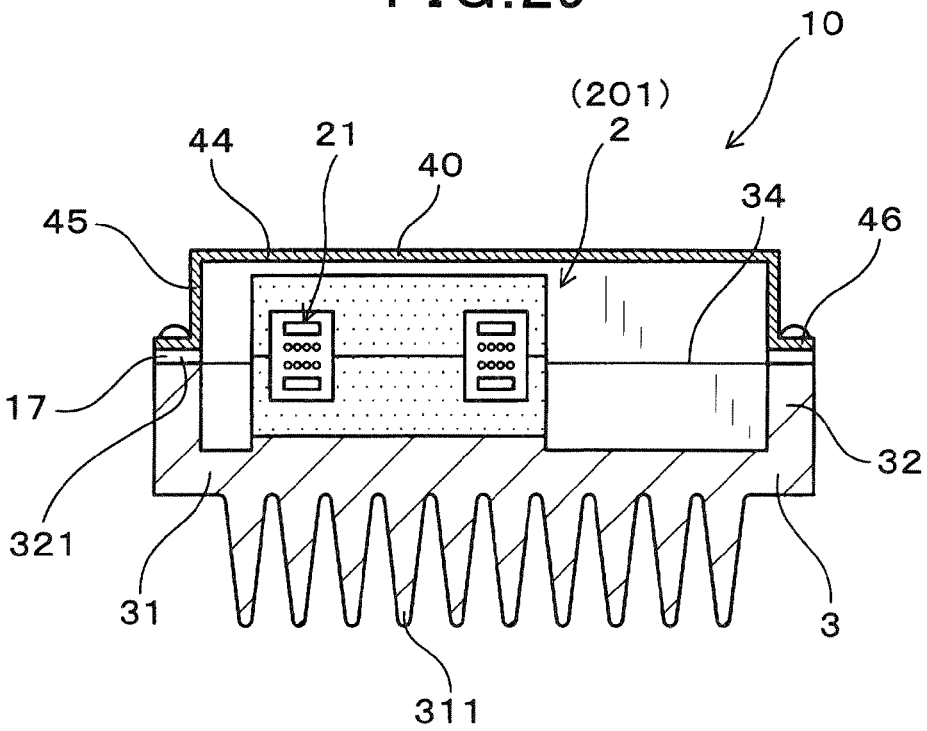
FIG. 29 is a cross-sectional view taken along line XXIX-XXIX in FIG. 28.

Next, an eighth embodiment of the invention is described with reference to FIGS. 28 and 29. As shown in FIGS. 28 and 29, in this embodiment, each side plate portion 32 of the case body 3 is formed with the projection 321. The female screws 51 are formed in the projections 321, and the case lid 40 is fastened to the case body 3 by engaging the male screws 52 with the male screw 51. Accordingly, the case lid 40 contacts with the case body 3 only at the projections 321, and the gaps 17 are present between the case body 3 and the case lid 40 at portions not formed with the projection 321 as is the case with the fourth embodiment. Except for the above, the eighth embodiment is the same in structure as the sixth embodiment.

According to this embodiment, it is possible to further increase the heat radiating performance of the power supply apparatus 10, while effectively suppressing leakage of the electromagnetic noise.

Ninth Embodiment

Figure 30:
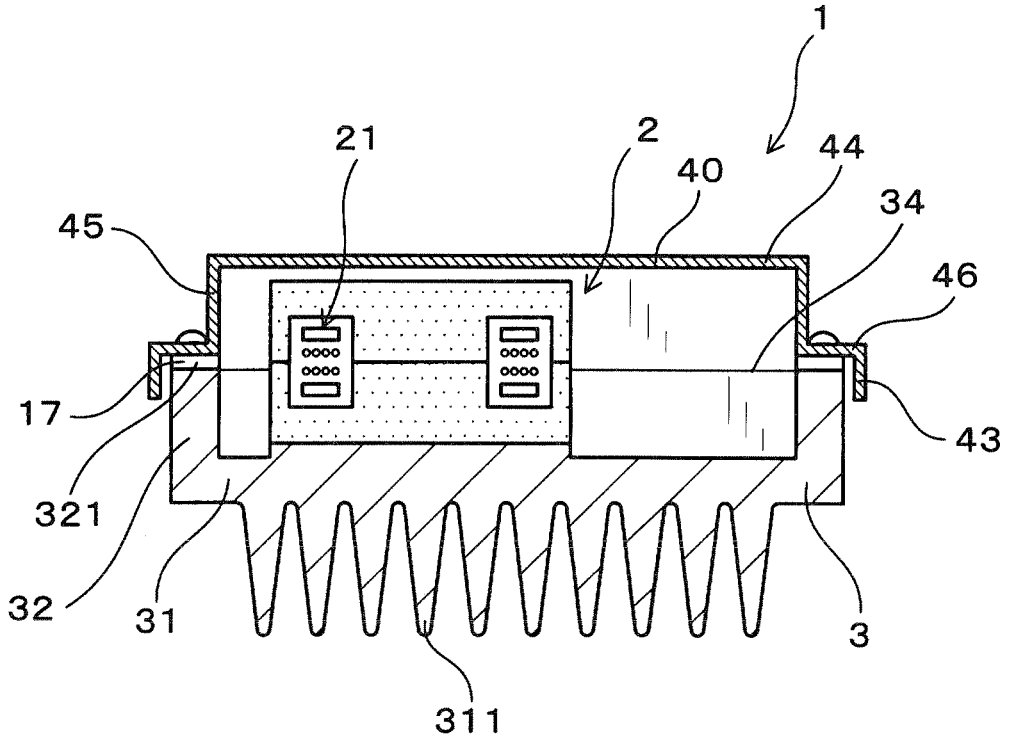
FIG. 30 is a cross-sectional view of a power supply apparatus according to a ninth embodiment of the invention.

Next, a ninth embodiment of the invention is described with reference to FIG. 30. As shown in FIG. 30, in this embodiment, the case lid 40 includes the standing portion 43 formed so as to stand from the circumferential edges thereof toward the case body 3. More specifically, the standing portion 43 stands from the edge of the flange portion 46 of the case lid 40. The standing portion 43 is located outside the side plate portions 32 of the case body 3 so as to cover from outside the gaps 17 present between the end surfaces of the side plate portions 32 and the inner surface 41 of the case lid 40. However, small gaps are provided between the standing portion 43 and the side plate portions 32. The structure and location of the standing portion 43 of this embodiment is approximately the same at those of the fifth embodiment.

Except for the above, this embodiment is the same in structure as the eighth embodiment.

According to this embodiment, by the provision of the standing portion 43, leakage of the electromagnetic noise can be suppressed more effectively.

Each of the above described embodiments relates to a DC-DC converter. However, the present invention can be used for various power supply apparatus other than a DC-DC converter, for example, an AC-AC converter.

The above explained preferred embodiments are exemplary of the invention of the present application which is described solely by the claims appended below. It should be understood that modifications of the preferred embodiments may be made as would occur to one of skill in the art.

What is claimed is:

1. A power supply apparatus comprising:

at least one magnetic component having a coil section of a ring shape;

a case body housing the magnetic component and having an opening plane facing an axial direction of the coil section, the case body being made of a conductor and constituted of a bottom plate portion and a plurality of side plate portions standing from circumferential edges of the bottom plate portion toward the opening plane;

a case lid having an inner surface facing the opening plane so as to close the opening plane and; and a plurality of conductive parts electrically connecting the case body and the case lid to each other at the opening plane at a resistance lower than any other portion of the case body and the case lid; wherein the conductive parts are provided so as to satisfy a positional relationship that at least one of the conductive parts is disposed at an intersection point at which a straight line making an angle within a range of 45±15 degrees with a perpendicular line drawn from a center of the coil section of the magnetic component to a closest one of the side plate portions to the center intersects with the closest one of side plate portions when viewed from the axial direction.

2. The power supply apparatus according to claim 1, wherein the magnetic component is more than one in number, and the conductive parts are provide so as to satisfy the positional relationship for each of the magnetic components.

3. The power supply apparatus according to claim 1, wherein the conductive parts are provided so as to satisfy a positional relationship that at least one of the conductive parts is disposed at an intersection point at each of which a straight line making an angle within a range of 45±15 degrees with a perpendicular line drawn from a center of the coil section of the magnetic component to each one of the side plate portions to the center intersects with each one of the side plate portions when viewed from the axial direction.

4. A power supply apparatus comprising:

at least one magnetic component having a coil section of a ring shape;

a case body housing the magnetic component and having an opening plane facing an axial direction of the coil section, the case body being made of a conductor and constituted of a bottom plate portion and a plurality of side plate portions standing from circumferential edges of the bottom plate portion toward the opening plane; and a case lid closing the opening plane, the case lid being made of a conductor and constituted of a top plate portion and a plurality of vertical plate portions extending down from the top plate portion toward the opening plane; wherein when an axial dimension of the coil section of the magnetic component is H, and a positional difference in the axial direction between a center of the coil section and the opening plane is $\Delta h$, a relationship of $\Delta h/H \leq 0.25$ is satisfied.

5. The power supply apparatus according to claim 4, wherein the magnetic component is more than one in number, and the relationship of $\Delta h/H \leq 0.25$ is satisfied for each of the magnetic components.

6. The power supply apparatus according to claim 1, wherein the magnetic component is at least one of a transformer and a choke coil.

* * * * *